US007175000B2

(12) United States Patent
Gyllenhammar et al.

(10) Patent No.: US 7,175,000 B2
(45) Date of Patent: Feb. 13, 2007

(54) LIFTING TRUCK WITH DISPLACEABLE MASTS AND BALANCING CYLINDER

(75) Inventors: Per Gyllenhammar, Motala (SE); Mikael Jakauby, Linkoping (SE)

(73) Assignee: BT Industries (SE)

( * ) Notice: Subject to any disclaimer, the term of this patent is extended or adjusted under 35 U.S.C. 154(b) by 392 days.

(21) Appl. No.: 10/453,025

(22) Filed: Jun. 3, 2003

(65) Prior Publication Data

US 2003/0230456 A1 Dec. 18, 2003

(30) Foreign Application Priority Data

Jun. 5, 2002 (SE) ..... 0201709

(51) Int. Cl.
*B66F 9/22* (2006.01)

(52) U.S. Cl. ..... 187/234; 187/226

(58) Field of Classification Search ..... 187/222, 187/226, 228, 230, 234, 238, 253, 406
See application file for complete search history.

(56) References Cited

U.S. PATENT DOCUMENTS

| | | | | | |
|---|---|---|---|---|---|
| 2,480,066 | A | * | 8/1949 | Weaver | 187/227 |
| 2,518,251 | A | * | 8/1950 | Quayle | 187/226 |
| 2,666,501 | A | * | 1/1954 | Abbe | 187/234 |
| 2,678,746 | A | * | 5/1954 | Gibson | 414/667 |
| 2,821,264 | A | * | 1/1958 | Ulinski | 187/226 |
| 2,915,144 | A | * | 12/1959 | Olson | 187/238 |
| 2,936,047 | A | * | 5/1960 | Quayle | 187/238 |
| 2,973,835 | A | * | 3/1961 | Quayle | 187/234 |
| 2,987,140 | A | * | 6/1961 | Olson | 187/229 |
| 3,062,325 | A | * | 11/1962 | Quayle | 187/227 |
| 3,208,556 | A | * | 9/1965 | Shaffer | 187/226 |
| 3,937,346 | A | | 2/1976 | van der Laan | 214/730 |
| 4,289,441 | A | * | 9/1981 | Inaba et al. | 414/589 |
| 4,552,250 | A | * | 11/1985 | Luebrecht | 187/230 |
| 4,709,786 | A | | 12/1987 | David et al. | 187/9 |
| 4,721,187 | A | * | 1/1988 | Riddle | 187/228 |
| 4,765,441 | A | * | 8/1988 | David et al. | 187/226 |
| 4,896,748 | A | * | 1/1990 | Mikkelsen et al. | 187/226 |
| 4,961,316 | A | * | 10/1990 | Corke et al. | 60/431 |

FOREIGN PATENT DOCUMENTS

| | | | |
|---|---|---|---|
| DE | 37 13 648 | A1 * | 4/1986 |
| DE | 4306651 | | 9/1994 |
| EP | 156 194 | A2 * | 10/1985 |
| GB | 924053 | | 4/1963 |
| GB | 944225 | | 12/1963 |
| GB | 2086843 | | 5/1982 |

* cited by examiner

*Primary Examiner*—Thomas J Brahan
(74) *Attorney, Agent, or Firm*—Hayes Soloway P.C.

(57) ABSTRACT

A lifting truck with a telescoping mast and a balancing cylinder is disclosed. The stages of the mast are each constructed with three vertical beams. A mechanism for extending the mast are contained in or near the side beams. The balancing cylinder exerts an upward force to counter the dead weight of the telescoping stages and other parts of the truck that are lifted. The balancing cylinder is connected to the lower portion of the first stage and the upper portion of the second stage. The beams making up the stages of the mast can be tubular or U-shaped to allow space for the balancing cylinder and/or hydraulic lines or control leads.

14 Claims, 5 Drawing Sheets

LIFTING TRUCK WITH DISPLACEABLE MASTS AND BALANCING CYLINDER

FIELD OF INVENTION

The present invention is generally related to industrial lifting trucks and, more particularly, is related to a high lifting forklift with displaceable masts.

BACKGROUND OF THE INVENTION

A typical design for lifting trucks includes load forks connected to a telescoping mast with two or more stages. In this configuration, the lifting truck can maximize potential lifting height while maintaining a low center of gravity during transport. This also allows the truck to pass through openings with much lower clearance than the potential lifting height of the truck. For most lifting trucks with telescoping masts, the load forks have a limited vertical range without the use of the telescoping mast. This is called free lift. However, when lifting to greater heights, where one or more stages of the telescoping mast are raised, the effective load lifted by the truck is increased by the weight of the moving stages.

Each stage is constructed with three vertical beams arranged so that the footprint of the beams forms an isosceles triangle. The stages are coupled in known manner so that all stages move in relation to each other during a lift. The guides and lifting means are arranged close to the vertical beams on the sides of the mast and the truck. The third vertical beam increases the strength and rigidity of the mast against both transverse and longitudinal forces.

One of the shortcomings of this design is that added force is required to lift the load when the telescoping feature of the mast is utilized. In addition to the load forks and the telescoping mast, many trucks also lift the operator, the operator's platform, and/or other means for load handling such as a fork pivot means. These extra weights represent an inefficient use of energy that has not been solved by current designs.

SUMMARY OF THE INVENTION

In order to remedy this problem, the present invention places a balancing cylinder in the central vertical beam of the second stage of the. Alternatively, the balancing cylinder may be located in the central vertical beam of the first stage. In either arrangement, the cylinder is ideally connected to an upper portion of the second stage and the lower portion of the first stage.

The balancing cylinder exerts an upward force on the second stage or lowest movable mast part that may counter the weight of the telescoping parts of the mast and other parts that are lifted. Thus, the lifting means of the truck is only required to lift the load on the forks. By placing the balancing cylinder in one of the central beams of the first or second stage, the view of the truck operator will not be obstructed and any aesthetic qualities of the exterior of the truck can be retained. To maximize the advantage of the balancing cylinder, an air pressure reservoir may be attached to the balancing cylinder.

Where the stages or mast parts are coupled so that they move relative to one another, a single balancing cylinder will provide support for the entire range of telescopic motion. The stages may be coupled together by fastening a chain to the first stage or lowest mast part, running the chain through a pulley or cogwheel at the top of the second stage or lowest movable mast part and down to the bottom of the third stage. In such a coupled arrangement, using the telescoping means to extend the second stage will also extend the third stage.

To facilitate the placement of the balancing cylinder, the vertical beams of the various stages or mast parts may be U-shaped. The central vertical beams of the first two stages or two lowest mast parts may be turned to face each other so that additional space is created. This may provide enough room for one or more additional balancing cylinders. Where the operator and the operator's platform are lifted along with the load, this space may also be useful for leads and connections needed for the operator's controls.

Other systems, methods, features, and advantages of the present invention may be apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

Figure 1:
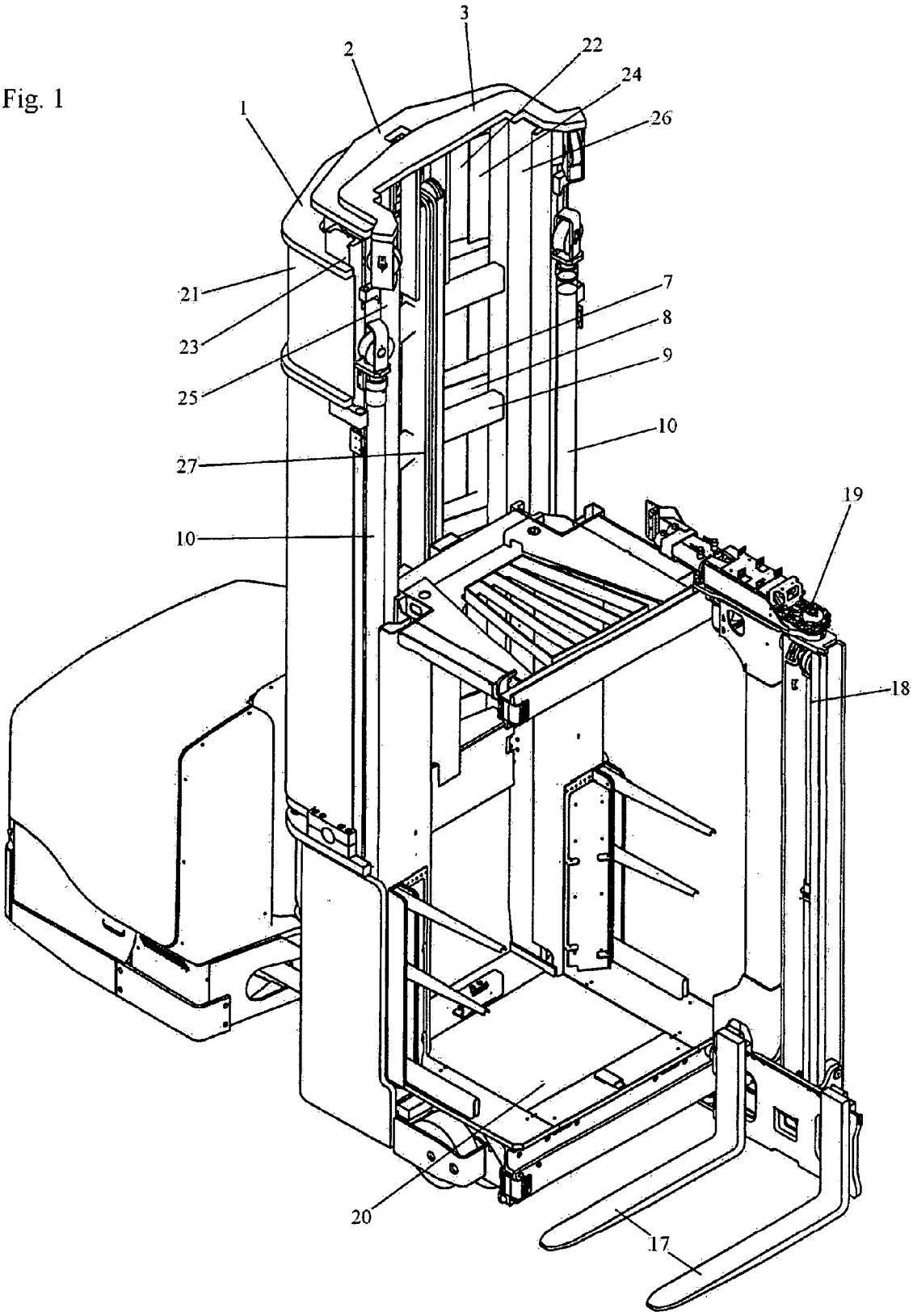
FIG. 1 is a perspective view of a truck consistent with a preferred embodiment of the present invention.

The drawings depict a lifting truck with a three-stage mast as modified by the present invention. The first stage 1 is fastened by some means to the chassis of said lifting truck. The second stage 2 is positioned within the first stage 1 and the third stage 3 is positioned within the second stage 2. The stages are constructed with three vertical beams each. The footprint of the side beams 21,22,23,24,25,26 and vertical beams 4,5,6 of each stage form an isosceles triangle. This configuration provides support against both transverse and longitudinal forces. Horizontal beams 7,8,9 connect the vertical beams of each individual stage.

The lifting truck also has load forks 17; a means for lifting and separating loads to be lifted. The load forks can be moved independently of the mast with a separate means for lifting 18. This is called free lift. The load may also be manipulated by other means, such as a fork pivot mechanism 19. The operator and the operator's platform 20 may be arranged such that they are lifted along with the load, load forks 17, and means for manipulating the load such as a fork pivot mechanism 19.

When lifting beyond the range of the free lift, the mast is extended telescopically. This is accomplished by a lifting means 10 located near the side beams 21,22,23,24,25,26.

The movements of the mast stages 1,2,3 are coupled by a means 27. This allows a single lifting means 10 to move the mast to its telescoping limit.

Figure 2:
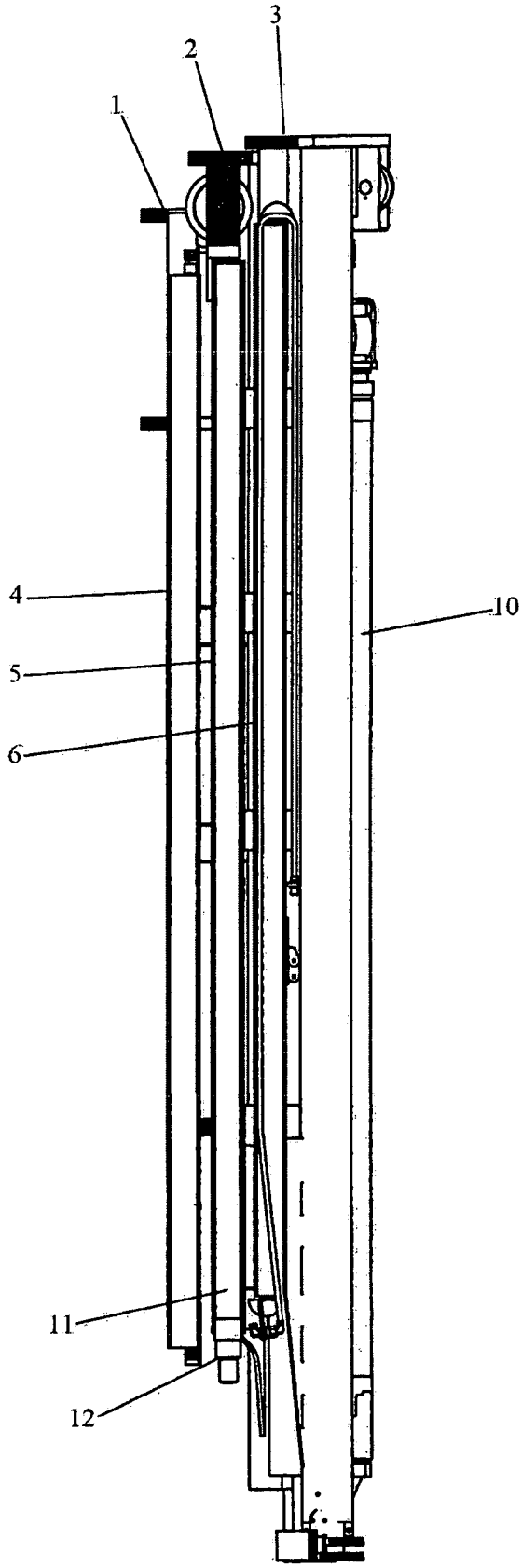
FIG. 2 is a cross-sectional side view of a mast of the truck of FIG. 1.
Figure 3:
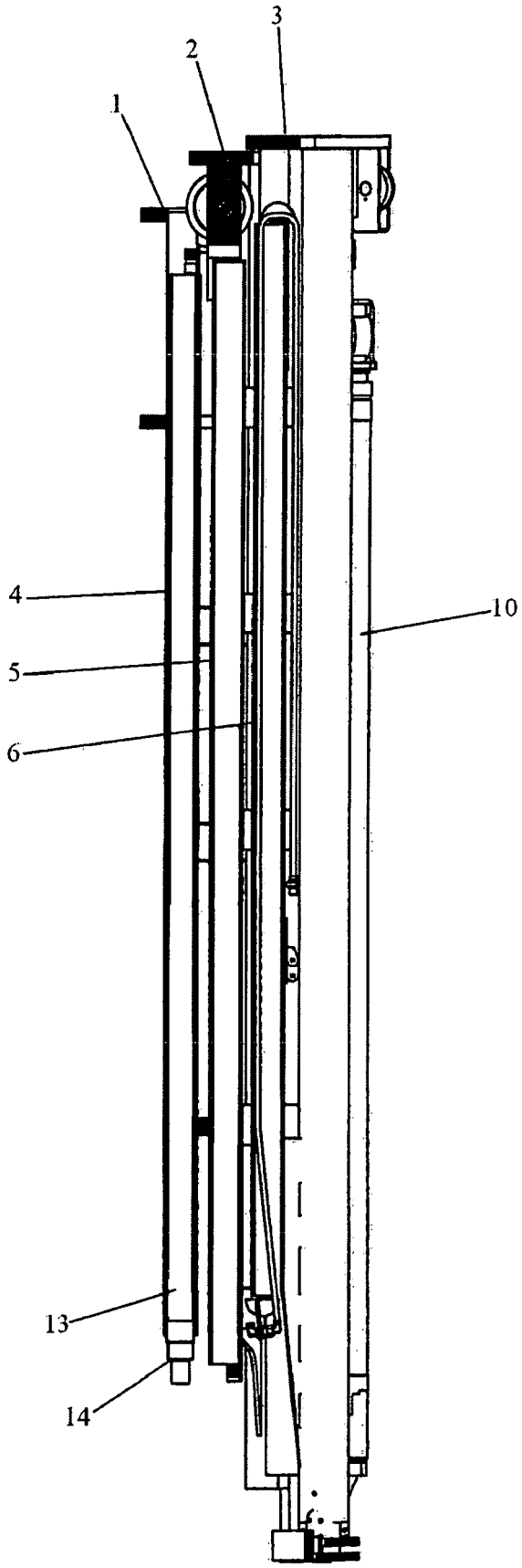
FIG. 3 is a cross-sectional side view of a mast of the truck of another preferred embodiment of the present invention.
Figure 4:
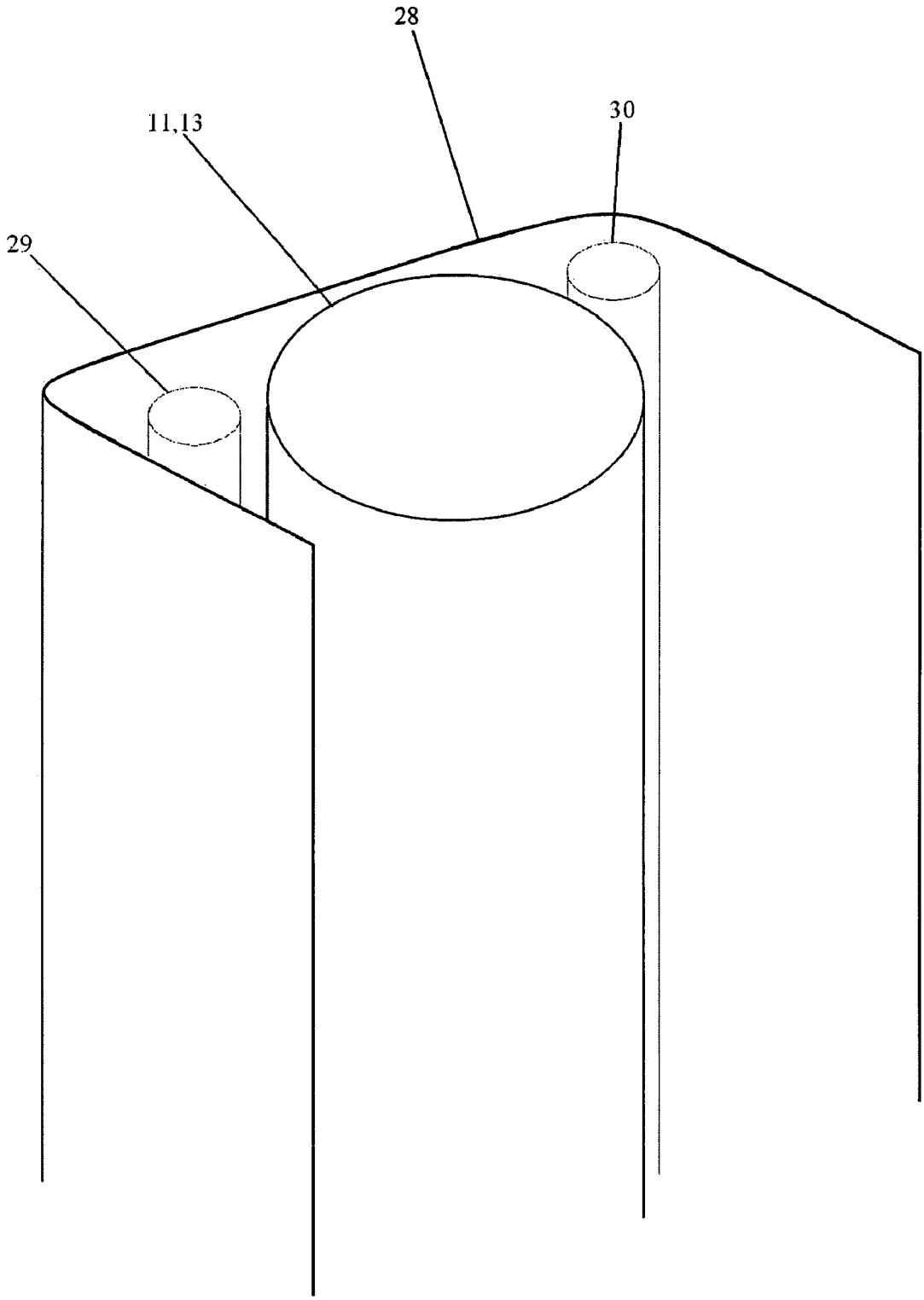
FIG. 4 is a simplified view of the central beam of one of the stages.
Figure 5:
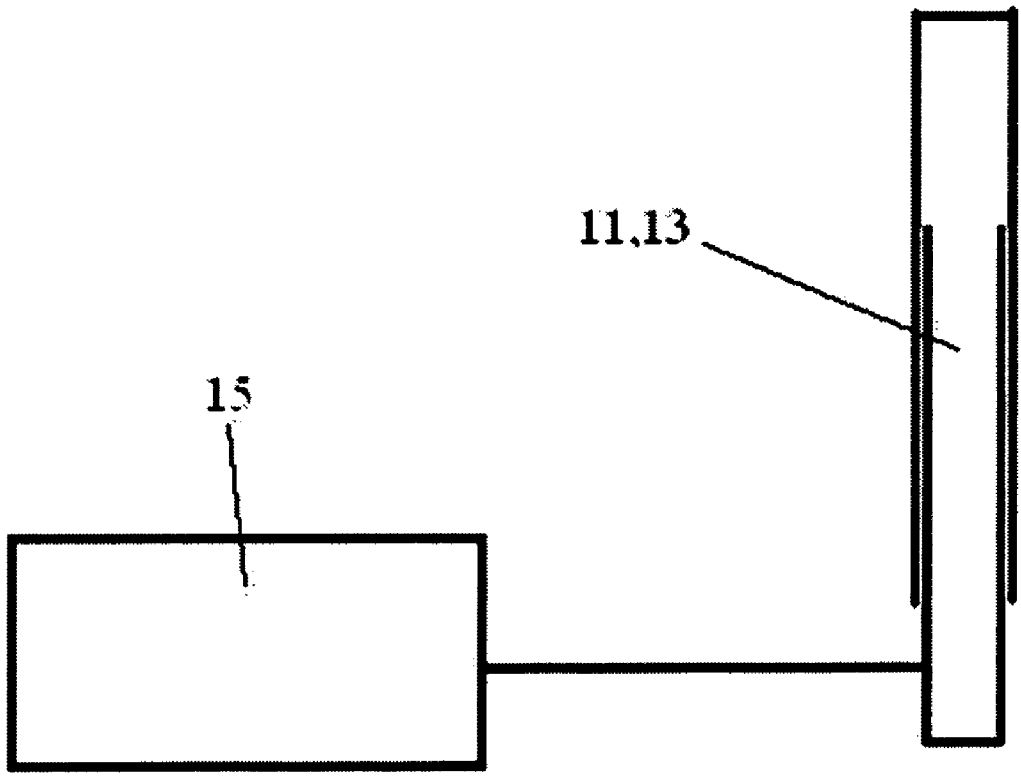
FIG. 5 is a schematic showing the air pressure reservoir.

To reduce the load on the lifting means 10, a balancing cylinder 11,13 is placed in the central beam of either the first or second stage 4,5 (see FIGS. 1 & 2). In either arrangement, the upper end of the balancing cylinder 11,13 is attached to the second stage 2 and the lower end of the balancing cylinder 11,13 is connected to the first stage 1 by means of a piston rod 12,14 which compresses or decompresses the fluid within the balancing cylinder. This provides an upward lifting force that initially counters the weight of the components of the lifting truck lifted along with the load.

Unfortunately, the upward force exerted by the balancing cylinder 11,13 dissipates as the load ascends and the pressure within the cylinder decreases. In order to maximize the advantage of the balancing cylinder 11,13, said cylinder may be attached to an air pressure reservoir 15,16.

Finally, all central beams 4,5,6 have are U or tube-shaped when viewed from above 28. This creates the space in which the balancing cylinder 11,13 can be placed. Any additional space, such as the space in central beams not housing the balancing cylinder, can be used for other purposes such as providing a location for hydraulic conduits or electric leads for operator controls 29,30.

The above-described embodiments of the present invention are merely representations intended to provide a clear understanding of the principles of the invention. Many variations and modifications may be made to the above-described embodiment(s) of the invention without departing substantially from the spirit and principles of the invention. All such modifications and variations are intended to be included within the scope of this disclosure and protected by the following claims.

What is claimed is:

1. A lifting truck with a telescoping mast, wherein said mast comprises a plurality of stages including a first stage that is fastened to a chassis of said lifting truck and having two vertical side beams and a central vertical beam, and one or more additional stages positioned inside said first stage and vertically displaceable relative to said first stage and having two vertical side beams and a central vertical beam;

said lifting truck further comprising:

a mechanism for attaching a load to the mast;

a mechanism for raising the vertically displaceable stages and a load carried by the truck arranged in or adjacent the side beams of the stages of said mast; and a balancing cylinder for applying an upward force on the telescoping mast to counter weight lifted by said mechanism for raising the vertically displaceable stages, said balancing cylinder being connected to an upper portion of the second stage and a lower portion of the first stage and positioned at the central vertical beam of the second stage.

2. The lifting truck of claim 1, further comprising an air pressure reservoir pneumatically connected to said balancing cylinder.

3. The lifting truck of claim 1, further comprising electrical cables and/or hydraulic conduits arranged in the central vertical beams of the stages of said mast.

4. The lifting truck of claim 1, wherein the load raised includes an operator and the operator's platform.

5. The lifting truck of claim 1, further comprising a free lifting mechanism.

6. The lifting truck of claim 1, further comprising a fork pivot mechanism.

7. The lifting truck of claim 1, wherein the central vertical beam is U or tube-shaped.

8. A lifting truck with a telescoping mast having a plurality of stages, wherein said mast comprises a plurality of stages including a first stage telescoping mast that is fastened to a chassis of said lifting truck and having two vertical side beams and a central vertical beam, and one or more additional telescoping mast stages positioned inside said first stage and vertically displaceable relative to said first stage and having two vertical side beams and a central vertical beam, said lifting truck further comprising:

a mechanism for attaching a load to the mast;

a mechanism for raising the vertically displaceable stages and a load carried by the truck arranged in or adjacent the side beams of the stages of said mast;

a balancing cylinder for applying an upward force on the telescoping mast to counter weight lifted by said mechanism for raising the vertically displaceable stages, said balancing cylinder being connected to an upper portion of the second stage and a lower portion of the first stage and positioned in the central vertical beam of the first stage.

9. The lifting truck of claim 8, further comprising an air pressure reservoir pneumatically connected to said balancing cylinder.

10. The lifting truck of claim 8, further comprising electrical cables and/or hydraulic conduits arranged in the central vertical beams of said mast stages.

11. The lifting truck of claim 8, wherein the load raised includes an operator and the operator's platform.

12. The lifting truck of claim 8, further comprising a free lifting mechanism.

13. The lifting truck of claim 8, further comprising a fork pivot mechanism.

14. The lifting truck of claim 8, wherein the central vertical beam is U or tube-shaped.

* * * * *